US006054953A

United States Patent [19]

Lindmark

[11] Patent Number: 6,054,953

[45] Date of Patent: Apr. 25, 2000

[54] DUAL BAND ANTENNA

[75] Inventor: Björn Lindmark, Stockholm, Sweden

[73] Assignee: Allgon AB, Akersberga, Sweden

[21] Appl. No.: 09/208,577

[22] Filed: Dec. 10, 1998

[51] Int. Cl.[7] ..... H01Q 1/38

[52] U.S. Cl. ..... 343/700 MS; 343/830; 343/846

[58] Field of Search ..... 343/700 MS, 829, 343/830, 846, 848, 841, 789; H01Q 1/38

[56] References Cited

U.S. PATENT DOCUMENTS

| | | | |
|---|---|---|---|
| 4,903,033 | 2/1990 | Tsao et al. | 343/700 MS |
| 5,030,961 | 7/1991 | Tsao | 343/700 MS |
| 5,241,321 | 8/1993 | Tsao | 343/700 MS |
| 5,355,143 | 10/1994 | Zürcher et al. | 343/700 MS |
| 5,448,250 | 9/1995 | Day | 343/700 MS |
| 5,633,645 | 5/1997 | Day | 343/700 MS |

FOREIGN PATENT DOCUMENTS

| | | |
|---|---|---|
| 0520908 | 12/1992 | European Pat. Off. . |
| WO97/43799 | 11/1997 | WIPO . |

OTHER PUBLICATIONS

IEEE AP–S Int. Symp., F. Y. Colomb et al, "Stacked patches with a slot in the common wall", Chicago, Jul. 1992, pp. 2077–2080.

*Primary Examiner*—Hoanganh Le
*Attorney, Agent, or Firm*—Jacobson, Price, Holman & Stern, PLLC

[57] ABSTRACT

An aperture-coupled antenna, comprising at least one antenna element including a number of substantially planar, mutually parallel radiating patches (1–3) being fed with microwave power from a feed network (6) via an aperture (5*a,* 5*b*) in a ground plane layer (4). The feed network (6) feeds microwave power in at least two separate frequency bands, including a first, relatively low frequency band and a second, relatively high frequency band. A first patch (2) radiates microwave power in the first frequency band and is provided with an aperture (9*a,* 9*b*) so as to couple microwave power in the second frequency band to a second patch (1), the microwave power in the second frequency band being fed from the feed network (6) via the apertures (5*a,* 5*b;* 9*a,* 9*b*) in the ground plane layer (4) and the first patch (2) to the second patch (1).

10 Claims, 3 Drawing Sheets

DUAL BAND ANTENNA

The present invention relates to a dual band antenna, comprising at least one antenna element including a number of substantially planar, mutually parallel radiating patches being fed with microwave power from a feed network via a coupling means in a ground plane layer of an electrically conductive material.

Similar antennas, some of them with only one radiating patch, are generally known in various forms. See e.g. the U.S. Pat. No. 5,030,961 (Tsao), U.S. Pat. No. 5,241,321 (Tsao), U.S. Pat. No. 5,355,143 (Zurcher et al.), the EP patent application, publication No. 520908 (Alcatel Espace) and the published international application PCT/SE97/00776 (Allgon).

Recently, the demand for antennas for mobile wireless applications has increased dramatically, and there are now a number of land and satellite based systems for wireless communications using a wide range of frequency bands. Accordingly, there is also a need for a single antenna element having radiating elements for patches being operable in two or more separate frequency bands.

The main object of the present invention is to provide such an antenna with an antenna element which is operable in at least two separate frequency bands, each band preferably being rather broad.

Another object is to provide an antenna with an antenna element operating with dual polarization in order to accomplish a desired diversity of the microwave radiation transmitted from or received by the antenna. Such diversity is especially useful for base station antennas. The dual polarized carrier waves should be orthogonal to each other with a good isolation therebetween, preferably better than 30 dB.

The main object, as stated above, is achieved in that the feed network is adapted to feed microwave power in at least two separate frequency bands, including a first, relatively low frequency band and a second, relatively high frequency band, a first one of said patches being adapted to radiate microwave power in said first frequency band and being provided with an aperture so as to couple microwave power in said second frequency band to a second one of said patches, the microwave power in said first frequency band being fed from said feed network via said coupling means at said ground plane layer to said first patch, and the microwave power in said second frequency band being fed from said feed network via said coupling means at said ground plane layer and via an aperture in said first patch to said second patch.

Thus, the first patch will have a dual operative function, i.e. it will serve as a radiating element but also as a coupling element so as to couple, by means of its aperture, the microwave power from the feed network and the aperture of the ground plane layer to the second patch.

In order to obtain an effective coupling, it is preferable to arrange a third patch between the ground plane layer and the first patch, the third patch serving to couple the microwave power in the second frequency band. The third patch should be substantially of the same size as the second patch but smaller than the first patch.

Dual polarization can be achieved in each frequency band. Advantageously, the coupling means at the ground plane layer comprises an aperture therein, and each of the apertures is cross-shaped with two crossing slots being perpendicular to one another. The first and second patches should then be centered in relation to the central point of the cross-shaped aperture of the ground plane layer.

These and other preferred features are stated in the appended claims and will appear from the detailed description below.

The invention will now be explained further with reference to the appended drawings, which illustrate a preferred embodiment of the invention.

Figure 1:
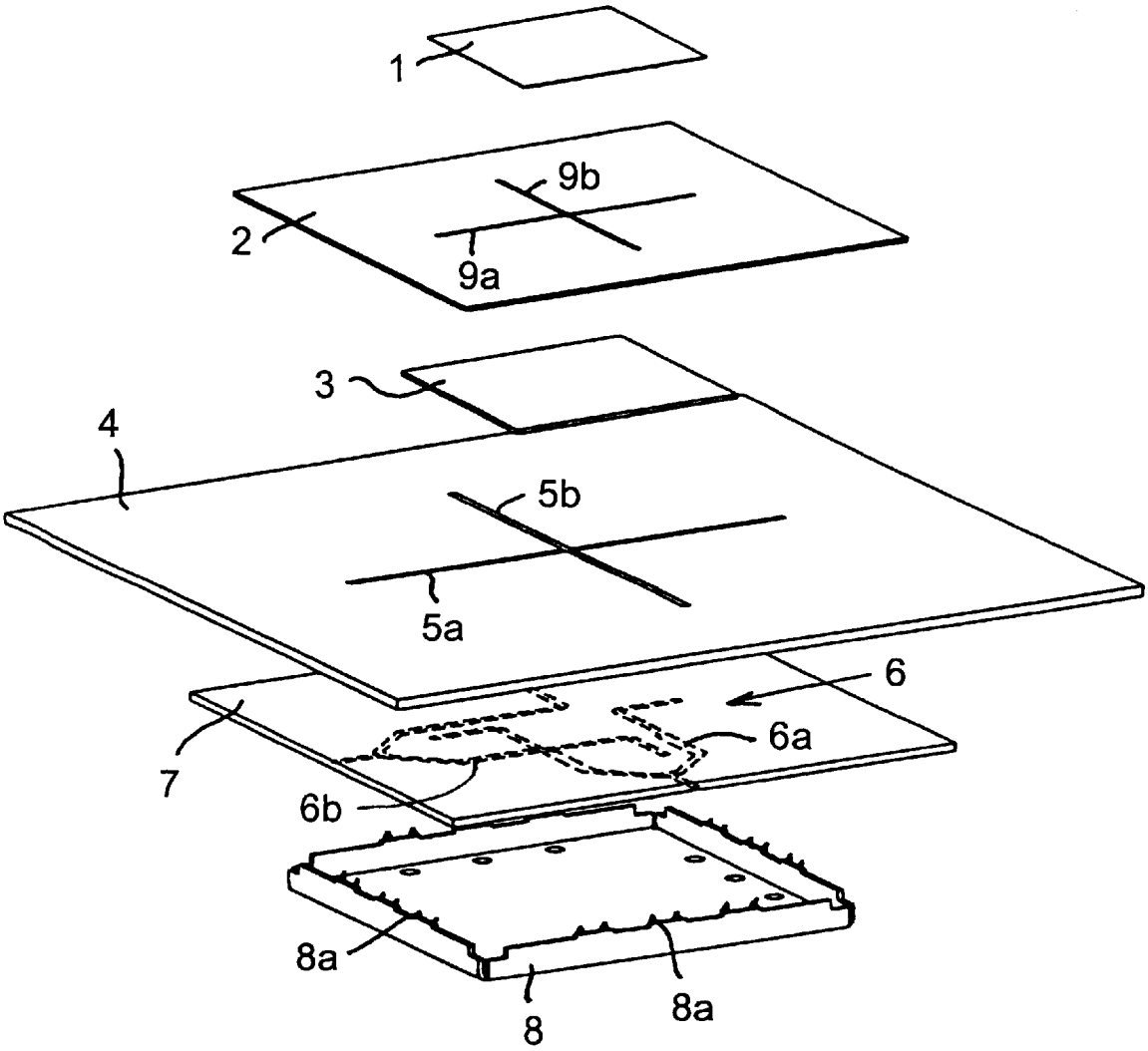
FIG. 1 is a perspective, exploded view of an antenna element with a number of substantially planar patches located on top of a ground plane layer having a cross-shaped aperture, a feed network and a bottom or rear shielding cage.

The antenna element shown very schematically in FIG. 1 comprises a patch structure with three substantially planar patch layers 1, 2 and 3 located one on top of the other and centered over a ground plane layer 4 serving as a reflector.

The ground plane layer 4 is made of an electrically conductive material, e.g. aluminum, and is provided with a centrally located cross-shaped aperture with two mutually perpendicular slots 5*a*, 5*b*. The cross-shaped aperture 5*a*, 5*b* is excited by a microstrip feed network 6 which is etched on a substrate layer 7 placed underneath the ground plane layer 4.

At the bottom, i.e. underneath or on the rear side of the substrate 7, there is a shielding cage 8 serving to prevent microwave propagation backwards or sideways in parallel to the plane defined by the ground plane layer 4. The shielding cage 8 is likewise made of an electrically conductive material, such as aluminum, and is preferably provided with upwardly projecting tongues os sharp pins 8*a*, which extend through corresponding holes in the substrate 7 and are connected to the ground plane layer 4, e.g. by soldered connections in corresponding bores in the ground plane layer 4 (not shown).

The patches 1, 2 and 3 are separated from each other by a foam material (not shown), e.g. of the kind denoted ROHACELL, having a permittivity of approximately 1.05. Preferably, the substrate layer 7 is made of a teflon material, such as DICLAD 527, being 0.762 mm thich and having a permittivity of 2.55.

Figure 2:
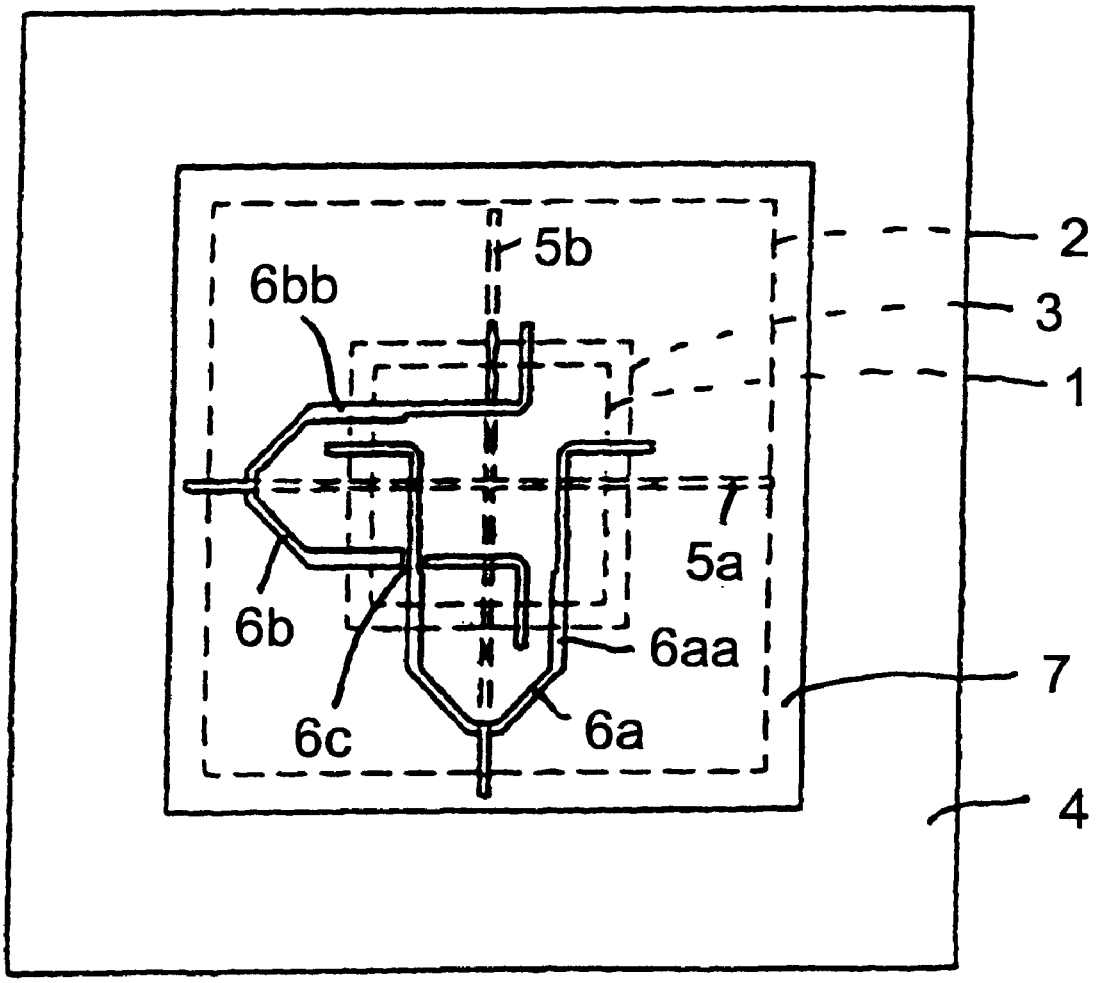
FIG. 2 is a view from the bottom of the antenna element shown in FIG. 1, the bottom shielding cage being removed for clarity.

As is known per se, the feed network 6 is provided with fork-like feed elements 6*a*, 6*b* which are perpendicular to each other and to a corresponding one of the slots 5*a*, 5*b* in the ground plane layer 4, the slots 5*a*, 5*b* serving as a coupling means for the microwave power. See also FIG. 2.

According to the present invention, the feed network 6 is adapted to feed microwave power in two separate frequency bands, including a first, relatively low frequency band, e.g. in the region 800–1000 MHz, and a second, relatively high frequency band, e.g. in the region 1700–2000 MHz.

In the lower frequency band, the feed elements 6*a*, 6*b* feed microwave power via the slots 5*a*, 5*b* (one vertically polarized channel and one horisontally polarized channel) to the relatively large radiating patch 2, which radiates microwave power in a well-defined pattern (upwardly in FIG. 1).

Moreover, the feed elements 6*a*, 6*b* will also feed microwave power in the second, relatively high frequency band via the slots 5*a*, 5*b* in the ground plane layer 4 and via a cross-shaped aperture 9*a*, 9*b* in the patch layer 2 to the upper, relatively small radiating patch 1.

In order to achieve an effective coupling, the cross-shaped aperture 9*a*, 9*b* consists of perpendicular slots 9*a* and 9*b*, which are parallel to a respective one of the slots 5*a*, 5*b*, though shorter in length. Also, the patch 3, located between the ground plane layer 4 and the patch 2, serves to enhance the coupling effect in the second, relatively high frequency band. The patch 3 should be slightly larger than or substantially of the same size as the radiating patch 1 but smaller than the radiating patch 2.

In the illustrated embodiment, the feed elements 6*a* and 6*b* are positioned in the same plane on the bottom of the substrate layer 7. Therefore, it is necessary to have an air bridge at the crossing point 6*c* of the two feed elements 6*a*, 6*b*. Each feed element is divided into two 50 Ω branches which end in open circuit stubs. In both frequency bands, a small amount of symmetrical capacitive tuning is provided by way of short sections 6*aa*, 6*bb* being somewhat wider about 30 mm before the respective aperture slot 5*a*, 5*b*.

The size and position of the relatively large radiating patch 2 are chosen for good performance in the lower frequency band, the length and width of the patch 2 corresponding essentially to the lengths of the slots 5*a* and 5*b*. Obviously, the patches 1, 2, 3 do not have to be square or rectangular but can have some other configuration, e.g. circular or rombic. In case dual polarization is used, they should be symmetrical with reference to a rotation of 90° or a multiple thereof.

The slots 9*a*, 9*b* in the radiating patch 2 should be shorter than the slots 5*a*, 5*b*. Preferably, the respective length of these slots 9*a*, 9*b* should correspond to the dimensions of the relatively small radiating patch 1. As mentioned above, the coupling patch 3 should be slightly larger than or substantially of the same size as the radiating patch 1.

Moreover, the slots 9*a*, 9*b* may be rotated at an angle, e.g. 45°, relative to the longer slots 5*a*, 5*b*.

It is to be noted that the relatively large radiating patch 2 functions as a ground plane for the relatively small top patch 1. This has been confirmed in practical experiments. In fact, it was found that the radiation patterns from the patches 1 and 2 were quite similar. Also, the ratio between the size of the patch 2 and the ground plane layer 4 is approximately equal to the ratio between the small patch 1 and the large patch 2.

It has also been found that it is possible to adjust the width of the radiated microwave beam by varying the width of the respective patch 1, 2.

Experiments have also confirmed that the shielding cage or box 8 reduces the radiation backwards to practically zero. Here, it is important that the cage or box 8 is directly connected to the ground plane layer 4. As an alternative, this can be achieved by means of electrically conducting screws.

Practical experiments have also shown that it is possible to achieve a return loss of at least 15 dB in the lower band (GSM) for both channels. In the upper band (DCS) the return loss is greater than 10 dB. Moreover, the band widths for return loss greater than 10 dB were 14.3% around 920 MHz and 14.7% around 1795 MHz. Finally, the isolation between the two channels in each frequency band proved to be greater than 32 dB.

Figure 3:
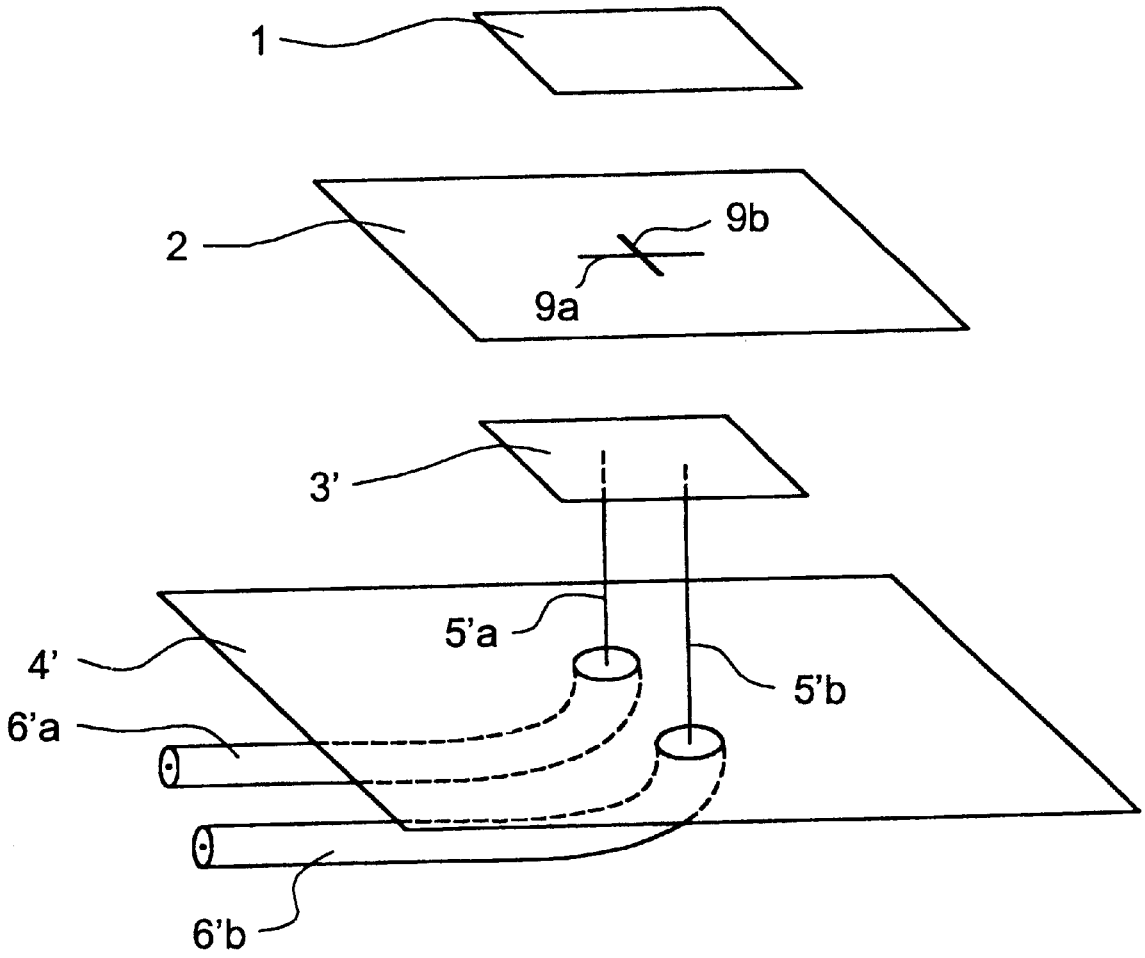
FIG. 3 is a perspective view, corresponding to FIG. 1, of a second embodiment of the antenna element.

FIG. 3 shows a slightly different embodiment where the feed network is constituted by coaxial cables 6'*a* and 6'*b*, one for each polarization. At the ground layer 4', these cables are connected to probes 5'*a* and 5'*b*, respectively. The central conductor of each cable 6'*a*, 6'*b* is thus connected to the respective probe 5'*a*, 5'*b*, which in turn is connected to the coupling patch 3', whereas the outer, tubular conductor of each coaxial cable is connected to the ground plane layer 4'. If so desired, there may be more than one pair of coaxial cables and probes. Also, in principle, it is possible to combine probe feeding and aperture-coupling, one for each polarization.

The antenna according to the invention may be modified within the scope of the appended claims. The antenna may comprise two or several antenna elements in a row or in several rows in a matrix arrangement. Moreover, each antenna element may comprise more than two radiating patches, each radiating in a specific frequency band. Preferably, the frequency bands are widely separated from each other, typically by an octave between adjacent frequency bands. Moreover, as indicated above, the dual polarization may be linear as shown, or circular. Of course, the inventive concept may also be applied without dual polarization. In such a case, the apertures in the ground plane layer 4 and in the patch 2 do not have to be cross-shaped but may have any desired configuration.

I claim:

1. A dual band antenna, comprising at least one antenna element including a number of substantially planar, mutually parallel radiating patches (1–3) being fed with microwave power from a feed network (6) via a coupling means (5*a*, 5*b*; 5'*a*, 5'*b*) at a ground plane layer (4) of an electrically conductive material, wherein said feed network is adapted to feed microwave power in at least two separate frequency bands, including a first, relatively low frequency band and a second, relatively high frequency band, a first one of said patches (2) being adapted to radiate microwave power in said first frequency band and being provided with an aperture (9*a*, 9*b*) so as to couple microwave power in said second frequency band to a second one (1) of said patches, the microwave power in said first frequency band being fed from said feed network (6) via said coupling means at said ground plane layer to said first patch (2), and the microwave power in said second frequency band being fed from said feed network (6) via said coupling means at said ground plane layer (4) and via said aperture (9*a*, 9*b*) in said first patch (2) to said second patch (1).

2. A dual band antenna as defined in claim 1, wherein a third patch (3; 3'), serves a coupling means, is located between said ground plane layer (4) and said first patch (2).

3. A dual band antenna as defined in claim 2, wherein said third patch (3; 3') is substantially of the same size as said second patch (1) but smaller than said first patch (2).

4. A dual band antenna as defined in claim 1, wherein said feed network (6*a*, 6*b*) is adapted to feed said microwave power with dual polarization in each of said frequency bands, said coupling means at said ground plane layer (4') comprising at least one pair of probes (5'*a*, 6'*b*), one probe for each polarization in each pair.

5. A dual band antenna as defined in claim 1, wherein said feed network (6) is adapted to feed said microwave power with dual polarization in each of said frequency bands, wherein said coupling means at said ground plane layer (4) comprises an aperture (5*a*, 5*b*) therein, and wherein each of said apertures is cross-shaped with two crossing slots (5*a*, 5*b*; 9*a*, 9*b*) being perpendicular to one another, and said first and second patches (2, 1) being centered in relation to the central point of said cross-shaped aperture (5*a*, 5*b*) of said ground plane layer (4).

6. A dual band antenna as defined in claim 5, wherein the length of the slots (5*a*, 5*b*) in the cross-shaped aperture in the ground plane layer (4) are greater than those (9*a*, 9*b*) of the cross-shaped aperture in the first patch (2).

7. A dual band antenna as defined in claim 5, wherein said feed network is constituted by a planar microstrip network (6) having two separate feed elements (6*a*, 6*b*) adapted to feed an associated one of the two slots (5*a*, 5*b*) of the cross-shaped aperture in said ground plane layer (4).

8. A dual band antenna as defined in claim 5, wherein a box-like shielding metal structure (8) is located the side of said ground plane layer (4) facing away from said first patch (2), said box-like shielding metal structure (8) being centered in relation to the cross-shaped aperture (5*a*, 5*b*) in said ground plane layer (4).

9. A dual band antenna as defined in claim 1, wherein a center frequency of the second frequency band is approximately an octave higher than a center frequency of said first frequency band.

10. A dual band antenna as defined in claim, wherein said center frequency of said first frequency band is in the region 800–1000 MHz, whereas said center frequency of said second frequency band is in the region 1700–2000 MHz.

* * * * *